US009352900B2

(12) United States Patent
Zhao et al.

(10) Patent No.: US 9,352,900 B2
(45) **Date of Patent: *May 31, 2016**

(54) SUPPORT FRAME FOR PACKAGING LIQUID CRYSTAL GLASS PANEL

(71) Applicant: Shenzhen China Star Optoelectronics Technology Co., Ltd., Shenzhen, Guangdong Province (CN)

(72) Inventors: Zhilin Zhao, Shenzhen (CN); Shihhsiang Chen, Shenzhen (CN); Jiahe Cheng, Shenzhen (CN)

(73) Assignee: SHENZHEN CHINA STAR OPTOELECTRONICS TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/720,710

(22) Filed: May 22, 2015

(65) Prior Publication Data

US 2015/0266661 A1 Sep. 24, 2015

Related U.S. Application Data

(62) Division of application No. 13/577,251, filed on Aug. 5, 2012, now Pat. No. 9,139,357.

(30) Foreign Application Priority Data

Jun. 15, 2012 (CN) ..... 2012 1 0199020

(51) Int. Cl.
*B65D 85/38* (2006.01)
*B65D 85/48* (2006.01)
(Continued)

(52) U.S. Cl.
CPC ..... *B65D 85/48* (2013.01); *B65D 77/0433* (2013.01); *B65D 81/05* (2013.01); *B65D 81/056* (2013.01); *B65D 85/38* (2013.01); *B65D77/0406* (2013.01); *B65D 77/0413* (2013.01); *B65D 2581/056* (2013.01); *B65D 2581/058* (2013.01); *B65D 2585/6837* (2013.01)

(58) Field of Classification Search
CPC ..... B65D 85/38; B65D 85/48; B65D 81/05; B65D 81/056; B65D 77/0433; B65D 77/0406; B65D 77/0413
USPC ..... 206/449, 453–456, 521, 577, 586, 600; 211/41.1, 41.14, 189, 195, 205, 206; 220/4.28, 4.33, 9.4
See application file for complete search history.

(56) References Cited

U.S. PATENT DOCUMENTS 3,356,209 A * 12/1967 Pezely, Jr. ..... B65D 81/107 206/586
3,961,709 A * 6/1976 Rowley ..... B65D 85/48 206/454

(Continued)

*Primary Examiner* — Luan K Bui
(74) *Attorney, Agent, or Firm* — Cheng-Ju Chiang

(57) ABSTRACT

A support frame is provided for packaging a liquid crystal glass panel. The support frame includes four corner pieces, upper connection bars, and lower connection bars. The upper connection bars are connected to top ends of the corner pieces to form an upper sub-frame. The lower connection bars are connected to bottom ends of the corner pieces to form a bottom bracket, which includes a lower sub-frame corresponding to the upper sub-frame and a carriage rack located inside and connected to the lower sub-frame. The support frame is rigid and may reinforce a tray against deformation caused by stacking or handling trays. The support frame is of a knockdown arrangement composed of multiple components in such a way that a portion of the components may be shared for contained products of different sizes so as to reduce the manufacturing cost.

11 Claims, 6 Drawing Sheets

(51) Int. Cl.
*B65D 81/05* (2006.01)
*B65D 77/04* (2006.01)

(56) References Cited

U.S. PATENT DOCUMENTS 4,120,417 A * 10/1978 Aquino ..... B65D 7/18 220/9.4
5,299,685 A * 4/1994 Chin ..... B65D 81/02 206/586
5,655,662 A * 8/1997 Garcia ..... B65D 81/07 206/453
7,270,236 B2 * 9/2007 Angeletti ..... B65D 19/44 206/454
8,602,241 B1 * 12/2013 Kuo ..... B65D 21/086 220/4.28
2004/0108284 A1 * 6/2004 Huang ..... H01L 21/6734 206/454
2004/0149605 A1 * 8/2004 Ohtaki ..... H04B 1/3822 206/320
2008/0173597 A1 * 7/2008 Shiffet ..... A47B 47/027 211/206

* cited by examiner

SUPPORT FRAME FOR PACKAGING LIQUID CRYSTAL GLASS PANEL

CROSS REFERENCE TO RELATED APPLICATIONS

This is a continuation application of U.S. patent application Ser. No. 13/577,251, titled as "Support Frame for Packaging Liquid Crystal Glass Panel", filed on Aug. 5, 2012, now U.S. Pat. No. 9,139,357 issued on Sep. 22, 2015, which claims benefit of Chinese application No. 201210199020.7 filed on Jun. 15, 2012, the disclosure of which is incorporated by reference herein.

BACKGROUND OF THE INVENTION

1. Field of the Invention

The present invention relates to the field of packaging a liquid crystal display, and in particular to a support frame for packaging a liquid crystal glass panel.

2. The Related Arts

In the technical field of manufacturing liquid crystal displays, the manufacturing process of the liquid crystal displays include a process of assembling, in which components, such as a liquid crystal glass panel, a main control circuit, and an enclosure, are assembled together. These components were packaged previously to be later assembled to form a liquid crystal display. A liquid crystal glass panel, after being manufactured, is first packaged and held in a liquid crystal glass panel package box and is then transported in such a box to a corresponding assembling workstation.

Currently, various packaging methods are available for liquid crystal glass panels. One of the methods is a complete set of packaging solution of which the primary part is a vacuum suction molded article. The packaging method (as shown in FIG. 1) is using a vacuum suction molded tray 100 to carry liquid crystal glass panels 300 with soft pads 302 sandwiched between the liquid crystal glass panels 300 for separation. To take full advantage of the vertical space of a packaging box 700, vacuum suction molded trays 100 are first vertically stacked to a predetermined number and placed in a packaging bag 500 to be subsequently deposited into a packaging box 700. Accessories, such as cushioning pieces 900, are set at corners of the packaging box 700.

The vacuum suction molded tray is advantageous in high cleanliness, precise dimension, and excellent antistatic effect and is thus widely favored by various manufacturers of the industry. However, a vacuum suction molded tray is formed through a specific operation to suck a sheet material with vacuum and the material used is a soft material, which, once carrying a liquid crystal glass panel thereon, will cause downward sag due to the gravity (as shown in FIG. 2), and the deformation of the vacuum suction molded tray goes even severer especially when an operator uses hands to hold the vacuum suction molded tray or pick up the packaging bag for deposition into a box, causing random displacement and shifting. In a worse case, the amount of deformation of the vacuum suction molded tray will be transferred to the liquid crystal glass panel carried thereon, making a corresponding amount of deformation on the liquid crystal glass panel and eventually leading to breaking of the liquid crystal glass panel.

Further, a liquid crystal glass panel may alternatively be packaged with a tray made of foamed packaging material (such as EPS/EPP). In such a packaging process, to prevent the above discussed problem that the tray generates a deformation that leads to breaking of the liquid crystal glass panel, the bottom of the tray must be thickened, which consumes more material and increases the manufacturing cost.

SUMMARY OF THE INVENTION

An object of the present invention is to provide a support frame for packaging a liquid crystal glass panel, which provides reinforcement to a tray through a stiff support frame.

Another object of the present invention is to provide a support frame for packaging a liquid crystal glass panel, which is a knockdown arrangement to be commonly used for different sizes and thus lowering the manufacturing cost.

To achieve the above objects, the present invention provides a support frame for packaging a liquid crystal glass panel, which comprises: four corner pieces, a plurality of upper connection bars, and a plurality of lower connection bars. The plurality of upper connection bars is respectively connected to top ends of the four corner pieces to form an upper sub-frame. The plurality of lower connection bars is connected to bottom ends of the four corner pieces to form a bottom bracket. The bottom bracket comprises a lower sub-frame corresponding to the upper sub-frame and a carriage rack connected to the lower sub-frame and located inside the lower sub-frame.

The corner pieces, the upper connection bars, and the lower connection bars are all rigid.

The upper connection bars comprise two opposite first upper-side bars and two opposite second upper-side bars. The first and second upper-side bars are respectively connected to the four corner pieces to form the upper sub-frame that is rectangular.

The corner pieces have top ends forming first and second upper coupling slots corresponding to the first and second upper-side bars. The first and second upper-side bars each have two ends forming first and second upper jointing sections respectively corresponding to the first and second upper coupling slots. The first and second upper jointing sections are respectively received and removably retained in the first and second upper coupling slots to connect the first and second upper-side bars and the corner pieces together to form the upper sub-frame.

The first upper-side bars, the second upper-side bars, and the corner pieces are made with injection molding of HDPE, PP or ABS or are made of aluminum alloy.

The lower connection bars comprise four T-shaped pieces, a cruciform piece, six first lower-side bars, and six second lower-side bars. The T-shaped pieces, the cruciform piece, the first lower-side bars, the second lower-side bars, and the corner pieces collectively form the lower sub-frame that is of a rectangular configuration and the carriage rack that is of a cruciform configuration.

Two T-shaped pieces of the four T-shaped pieces have two opposite ends that are located on a straight line and are respectively connected to ends of two first lower-side bars and an additional end that is set perpendicular to said two ends and is connected to an end of one second lower-side bar. The other ends of the two first lower-side bars are respectively connected to the corner pieces. The other two T-shaped pieces of the four T-shaped pieces have two opposite ends that are located on a straight line and are respectively connected to ends of second lower-side bars and an additional end that is set perpendicular to said two ends and is connected to an end of one first lower-side bar. The other ends of the two second lower-side bars are respectively connected to the corner pieces. The other ends of the first and second lower-side bars that are connected to said additional ends of the T-shaped pieces that are set perpendicular to the opposite ends are respectively connected to ends of the cruciform piece.

The corner pieces form, in bottom ends thereof, first and second lower coupling slots respectively corresponding to the first and second lower-side bars. The first and second lower-side bars each have two ends forming the first and second lower jointing sections. The three ends of each of the T-shaped pieces form third lower coupling slots. The four ends of the cruciform piece form fourth lower coupling slots. The first lower jointing sections are engageable with the first lower coupling slots, the third lower coupling slots, or the fourth lower coupling slots. The second lower jointing sections are engageable with the second lower coupling slots, the third lower coupling slots, or the fourth lower coupling slots.

The T-shaped pieces, the cruciform piece, the first lower-side bars, and the second lower-side bars are made with injection molding of HDPE, PP, or ABS or are made of aluminum alloy.

Each of the corner pieces comprises a bottom plate and two side plates connected to two adjacent side edges of the bottom plate. The two side plates extend upward from the bottom plate and are connected perpendicularly. The two side plates of each of the corner pieces have top ends forming the first and second upper coupling slots that correspond to the first and second upper-side bars for mounting the first and second upper-side bars. The two side plates of each of the corner pieces have bottom ends forming the first and second lower coupling slots corresponding to the first and second lower-side bars for mounting the first and second lower-side bars.

The present invention also provides a support frame for packaging a liquid crystal glass panel, which comprises: four corner pieces, a plurality of upper connection bars, and a plurality of lower connection bars, the plurality of upper connection bars being respectively connected to top ends of the four corner pieces to form an upper sub-frame, the plurality of lower connection bars being connected to bottom ends of the four corner pieces to form a bottom bracket, the bottom bracket comprising a lower sub-frame corresponding to the upper sub-frame and a carriage rack connected to the lower sub-frame and located inside the lower sub-frame;

wherein the corner pieces, the upper connection bars, and the lower connection bars are all rigid;

wherein the upper connection bars comprise two opposite first upper-side bars and two opposite second upper-side bars, the first and second upper-side bars being respectively connected to the four corner pieces to form the upper sub-frame that is rectangular;

wherein the corner pieces have top ends forming first and second upper coupling slots corresponding to the first and second upper-side bars, the first and second upper-side bars each having two ends forming first and second upper jointing sections respectively corresponding to the first and second upper coupling slots, the first and second upper jointing sections being respectively received and removably retained in the first and second upper coupling slots to connect the first and second upper-side bars and the corner pieces together to form the upper sub-frame;

wherein the first upper-side bars, the second upper-side bars, and the corner pieces are made with injection molding of HDPE, PP or ABS or are made of aluminum alloy;

wherein the lower connection bars comprise four T-shaped pieces, a cruciform piece, six first lower-side bars, and six second lower-side bars, the T-shaped pieces, the cruciform piece, the first lower-side bars, the second lower-side bars, and the corner pieces collectively forming the lower sub-frame that is of a rectangular configuration and the carriage rack that is of a cruciform configuration;

wherein two T-shaped pieces of the four T-shaped pieces have two opposite ends that are located on a straight line and are respectively connected to ends of two first lower-side bars and an additional end that is set perpendicular to said two ends and is connected to an end of one second lower-side bar, the other ends of the two first lower-side bars being respectively connected to the corner pieces; the other two T-shaped pieces of the four T-shaped pieces have two opposite ends that are located on a straight line and are respectively connected to ends of second lower-side bars and an additional end that is set perpendicular to said two ends and is connected to an end of one first lower-side bar, the other ends of the two second lower-side bars being respectively connected to the corner pieces; and the other ends of the first and second lower-side bars that are connected to said additional ends of the T-shaped pieces that are set perpendicular to the opposite ends are respectively connected to ends of the cruciform piece;

wherein the corner pieces form, in bottom ends thereof, first and second lower coupling slots respectively corresponding to the first and second lower-side bars, the first and second lower-side bars each having two ends forming the first and second lower jointing sections, three ends of each of the T-shaped pieces forming third lower coupling slots, four ends of the cruciform piece forming fourth lower coupling slots, the first lower jointing sections being engageable with the first lower coupling slots, the third lower coupling slots, or the fourth lower coupling slots, the second lower jointing sections being engageable with the second lower coupling slots, the third lower coupling slots, or the fourth lower coupling slots;

wherein the T-shaped pieces, the cruciform piece, the first lower-side bars, and the second lower-side bars are made with injection molding of HDPE, PP, or ABS or are made of aluminum alloy; and wherein each of the corner pieces comprises a bottom plate and two side plates connected to two adjacent side edges of the bottom plate, the two side plates extending upward from the bottom plate and connected perpendicularly, the two side plates of each of the corner pieces having top ends forming the first and second upper coupling slots that correspond to the first and second upper-side bars for mounting the first and second upper-side bars, the two side plates of each of the corner pieces having bottom ends forming the first and second lower coupling slots corresponding to the first and second lower-side bars for mounting the first and second lower-side bars.

The efficacy of the present invention is that the present invention provides a support frame for packaging a liquid crystal glass panel, wherein the support frame that is rigid may reinforce the tray in order to eliminate the problem of deformation of vacuum suction molded trays occurring in the known art when the trays are stacked or being handled. Further, the support frame is of a knockdown arrangement composed of multiple components in such a way that a portion of the components may be shared for contained products of different sizes so as to reduce the manufacturing cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of one or more embodiments of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
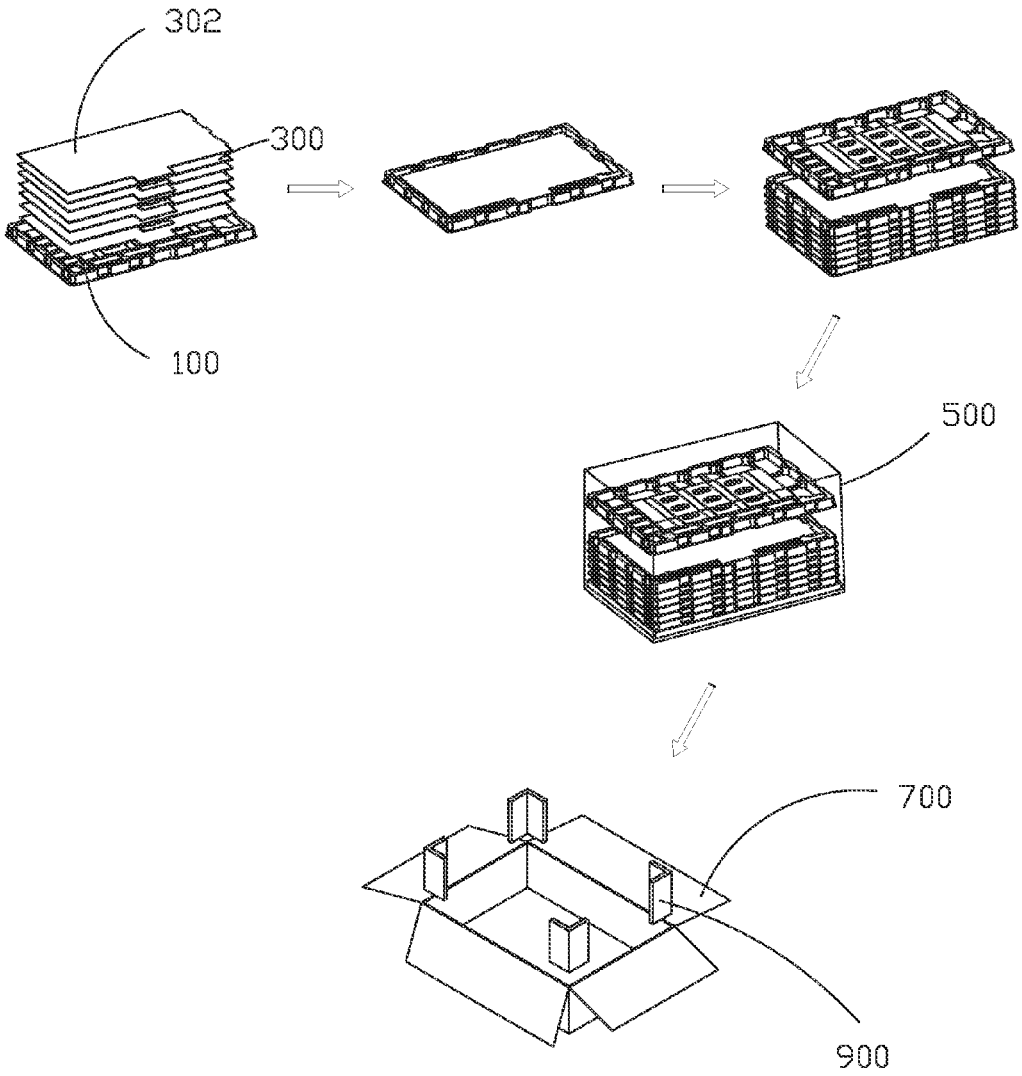
Fig. 1 (Prior Art)
FIG. 1 is a schematic view illustrating a conventional packaging process of a liquid crystal glass panel.
Figure 2:
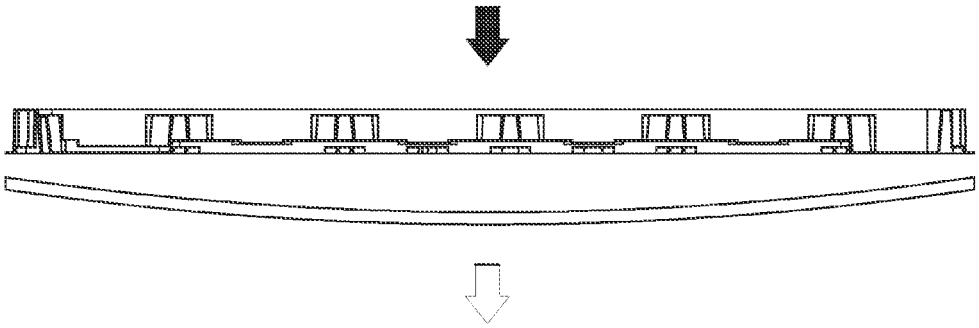
Fig. 2 (Prior Art)
FIG. 2 is a schematic view illustrating a liquid crystal glass panel is acted upon by an force and deforms.
Figure 3:
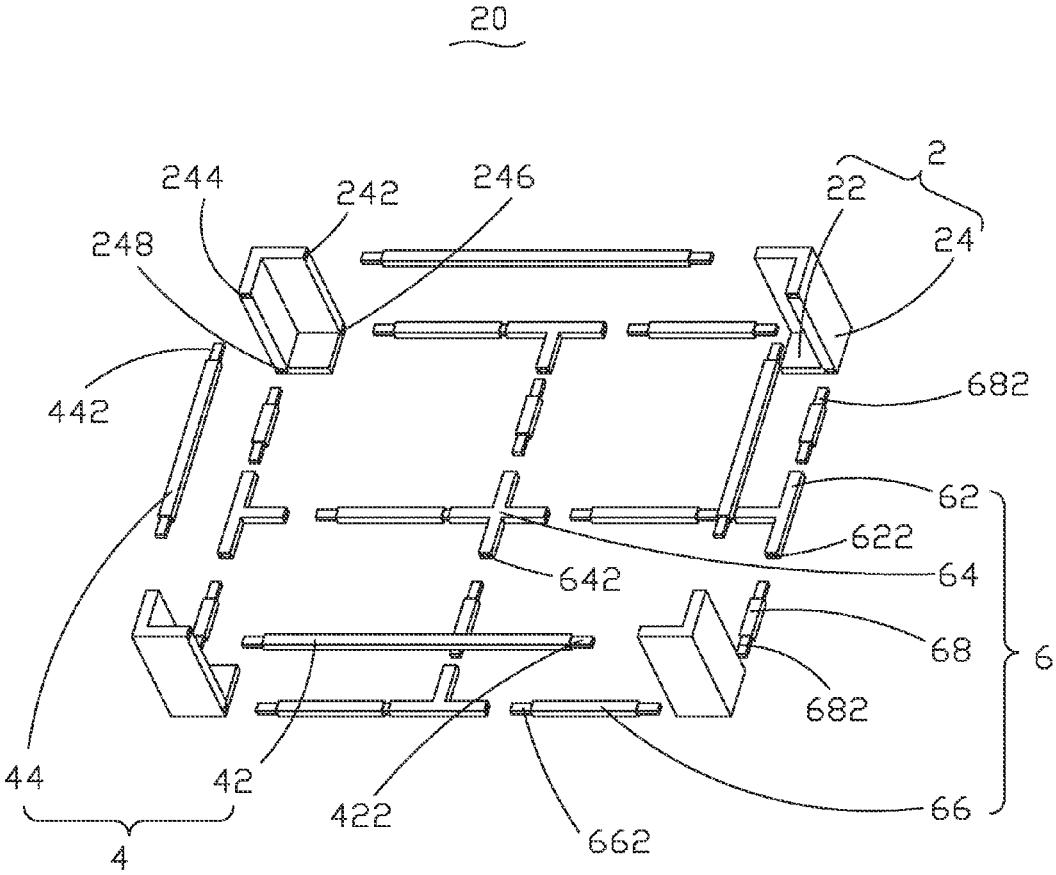
FIG. 3 is an exploded view showing a support frame for packaging a liquid crystal glass panel according to the present invention.
Figure 4:
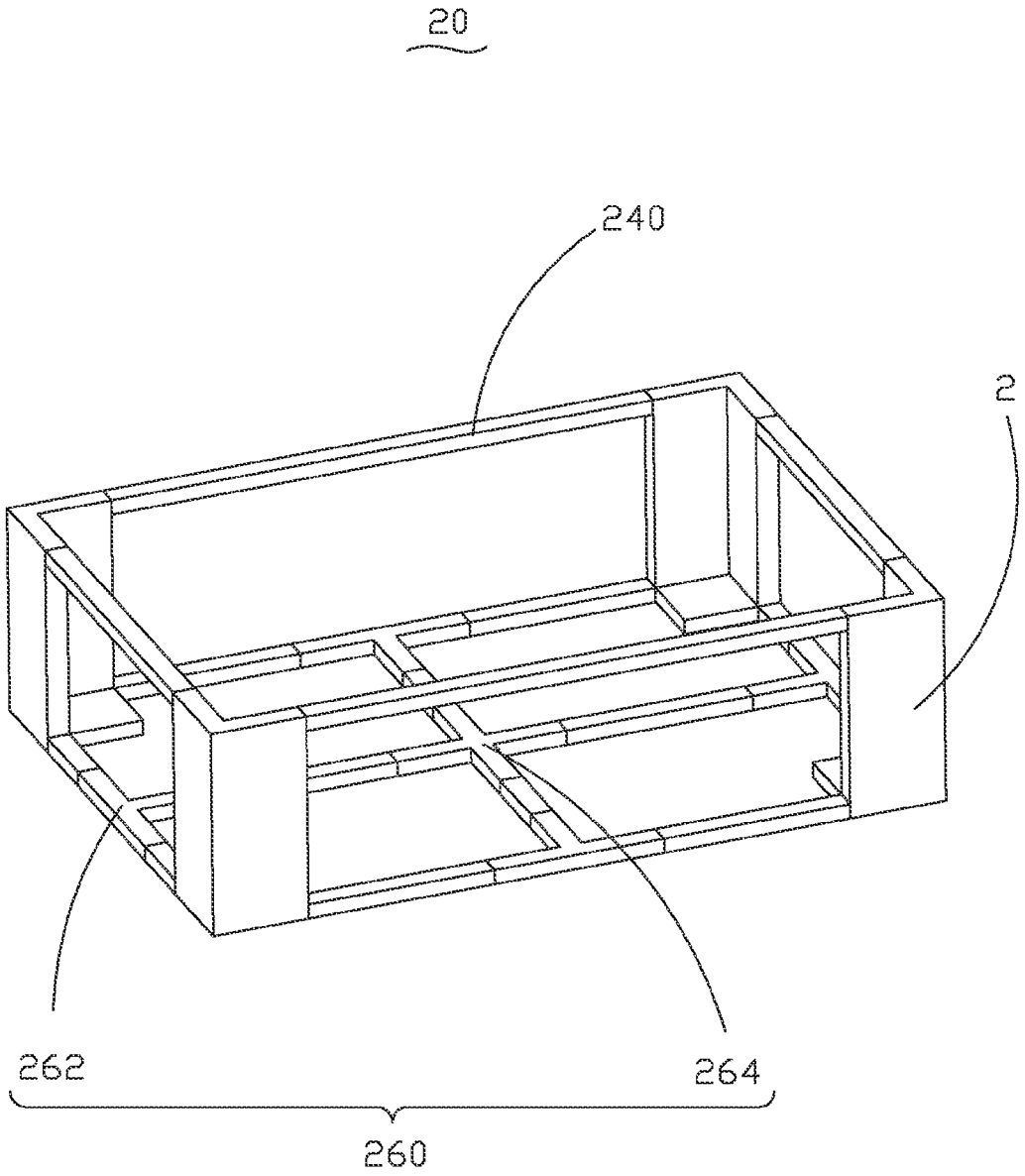
FIG. 4 is a perspective view, in an assembled form, showing the support frame for packaging a liquid crystal glass panel according to the present invention.
Figure 5:
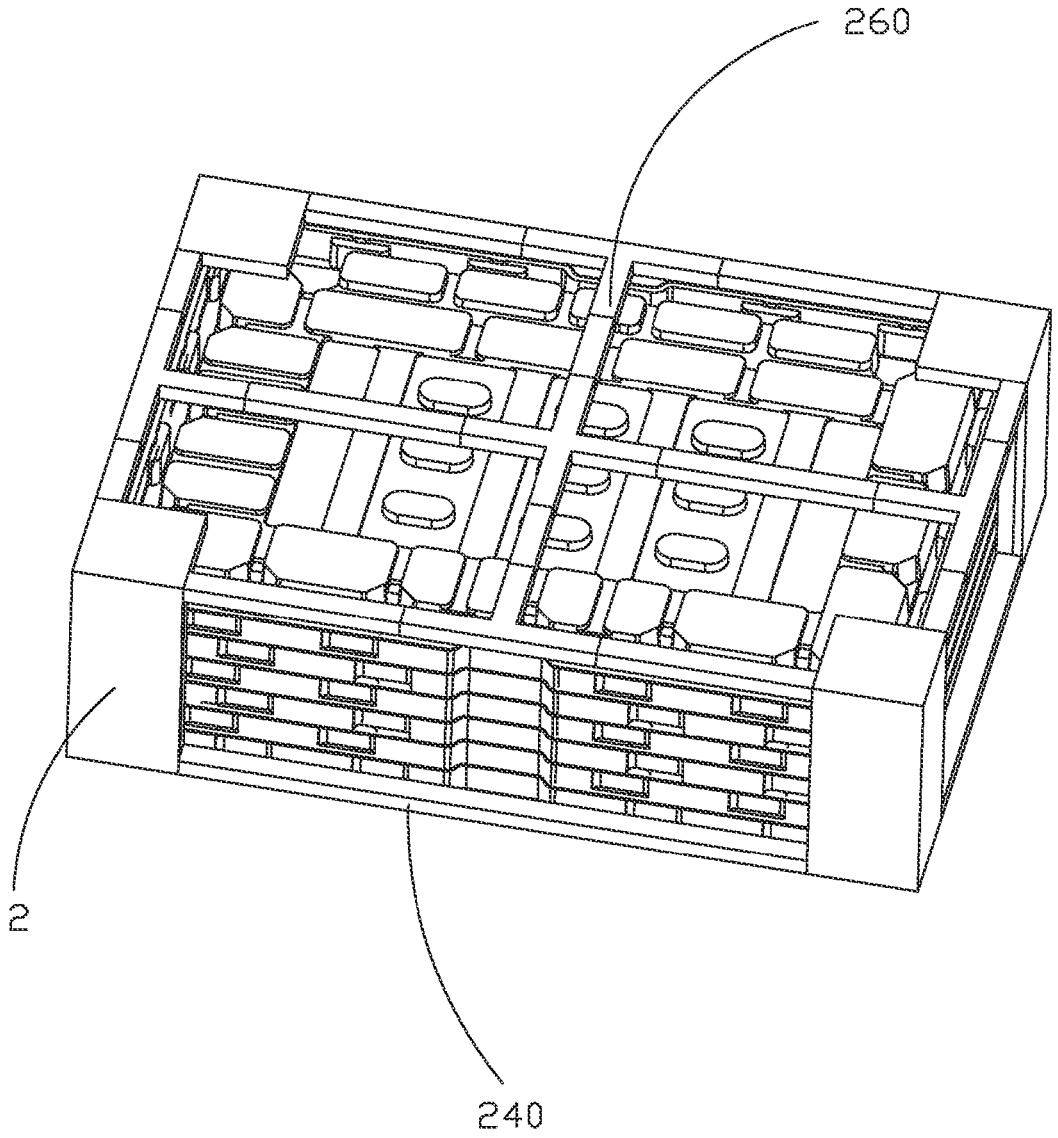
FIG. 5 is a bottom-side perspective view showing the support frame for packaging liquid crystal glass panel according to the present invention in which liquid crystal glass panels are received.

Referring to FIGS. 3-5, the present invention provides a support frame 20 for a packaging a liquid crystal glass panel, which comprises: four corner pieces 2, a plurality of upper connection bars 4, and a plurality of lower connection bars 6. The plurality of upper connection bars 4 is respectively connected to top ends of the four corner pieces 2 to form an upper sub-frame 240. The plurality of lower connection bars 6 is respectively connected to bottom ends of the four corner pieces 2 to form a bottom bracket 260. The bottom bracket 260 comprises a lower sub-frame 262 corresponding to the upper sub-frame 240 and a carriage rack 264 connected to the lower sub-frame 262 and located inside the lower sub-frame 262. The corner pieces 2, the upper connection bars 4, and the lower connection bars 6 are all rigid in order to reinforce the strength of a vacuum suction molded tray 40 that is supported inside the support frame 20 and thus protecting a liquid crystal glass panel (not shown) that is received in the vacuum suction molded tray 40 from breaking due to deformation of the vacuum suction molded tray 40 caused by an external force acting thereon.

Each of the corner pieces 2 comprises a bottom plate 22 and two side plates 24 connected to two adjacent side edges of the bottom plate 22. The two side plates 24 extend upward from the bottom plate 22 and are connected perpendicularly.

In the instant embodiment, the upper connection bars 4 comprise two opposite first upper-side bars 42 and two opposite second upper-side bars 44. The first and second upper-side bars 42, 44 are respectively connected to the four corner pieces 2 to form the upper sub-frame 240 that is rectangular. The side plates 24 of the corner pieces 2 have top ends forming first and second upper coupling slots 242, 244 corresponding to the first and second upper-side bars 42, 44. The first and second upper-side bars 42, 44 each have two ends forming first and second upper jointing sections 422, 442 respectively corresponding to the first and second upper coupling slots 242, 244. The first and second upper jointing sections 422, 442 are respectively received and removably retained in the first and second upper coupling slots 242, 244 to connect the first and second upper-side bars 42, 44 and the corner pieces 2 together to form the upper sub-frame 240.

The lower connection bars 6 comprise four T-shaped pieces 62, a cruciform piece 64, six first lower-side bars 66, and six second lower-side bars 68. The T-shaped pieces 62, the cruciform piece 64, the first lower-side bars 66, the second lower-side bars 68, and the corner pieces 2 collectively form the lower sub-frame 262 that is of a rectangular configuration and the carriage rack 264 that is of a cruciform configuration.

Two T-shaped pieces 62 of the four T-shaped pieces 62 have two opposite ends that are located on a straight line and are respectively connected to ends of two first lower-side bars 66 and an additional end that is set perpendicular to those two ends and is connected to an end of one second lower-side bar 68. The other ends of the two first lower-side bars 66 are respectively connected to the corner pieces 2. The other two T-shaped pieces 62 of the four T-shaped pieces 62 have two opposite ends that are located on a straight line and are respectively connected to ends of second lower-side bars 68 and an additional end that is set perpendicular to those two ends and is connected to an end of one first lower-side bar 66. The other ends of the two second lower-side bars 68 are respectively connected to the corner pieces 2. The other ends of the first and second lower-side bars 66, 68 that are connected to said additional ends of the T-shaped pieces 62 that are set perpendicular to the opposite ends are respectively connected to ends of the cruciform piece 64.

The side plates 24 of the corner pieces 2 form, in bottom ends thereof, first and second lower coupling slots 246, 248 respectively corresponding to the first and second lower-side bars 66, 68. The first and second lower-side bars 66, 68 each have two ends forming the first and second lower jointing sections 662, 682. The three ends of each of the T-shaped pieces form third lower coupling slots 622. The four ends of the cruciform piece 64 form fourth lower coupling slots 642. The first lower jointing sections 662 are engageable with the first lower coupling slots 246, the third lower coupling slots 622, or the fourth lower coupling slots 642. The second lower jointing sections 682 are engageable with the second lower coupling slots 248, the third lower coupling slots 622, or the fourth lower coupling slots 642.

The first upper-side bars 42, the second upper-side bars 44, the corner pieces 2, the T-shaped pieces 62, the cruciform piece 62, the first lower-side bars 66, and the second lower-side bars 68 are made with injection molding of high density polyethylene (HDPE), polypropylene (PP), or acrylonitrile butadiene styrene (ABS) or are made of aluminum alloy. The first upper-side bars 42, the second upper-side bars 44, the first lower-side bars 66, and the second lower-side bars 68 may be made of a metallic material, such as aluminum alloy, while the corner pieces 2, the T-shaped pieces 62, the cruciform piece 62 are made with injection molding of HDPE, PP, or ABS. This makes it possible for sharing mold and reducing manufacturing cost.

It is noted that in the instant embodiment, the first and second upper coupling slots 242, 244 and the first, second, third, and fourth lower coupling slots 246, 248, 622, 642 are of identical structure and size, and correspondingly, the first and second upper jointing sections 422, 442 and the first and second lower jointing sections 662, 682 are made to be of the same structure and size. This allows the assembling process thereof to be adjusted as desired to thereby adjust the overall size of the support frame 20 for effecting packaging of liquid crystal glass panels of various sizes and thus reducing the manufacturing cost.

Figure 6:
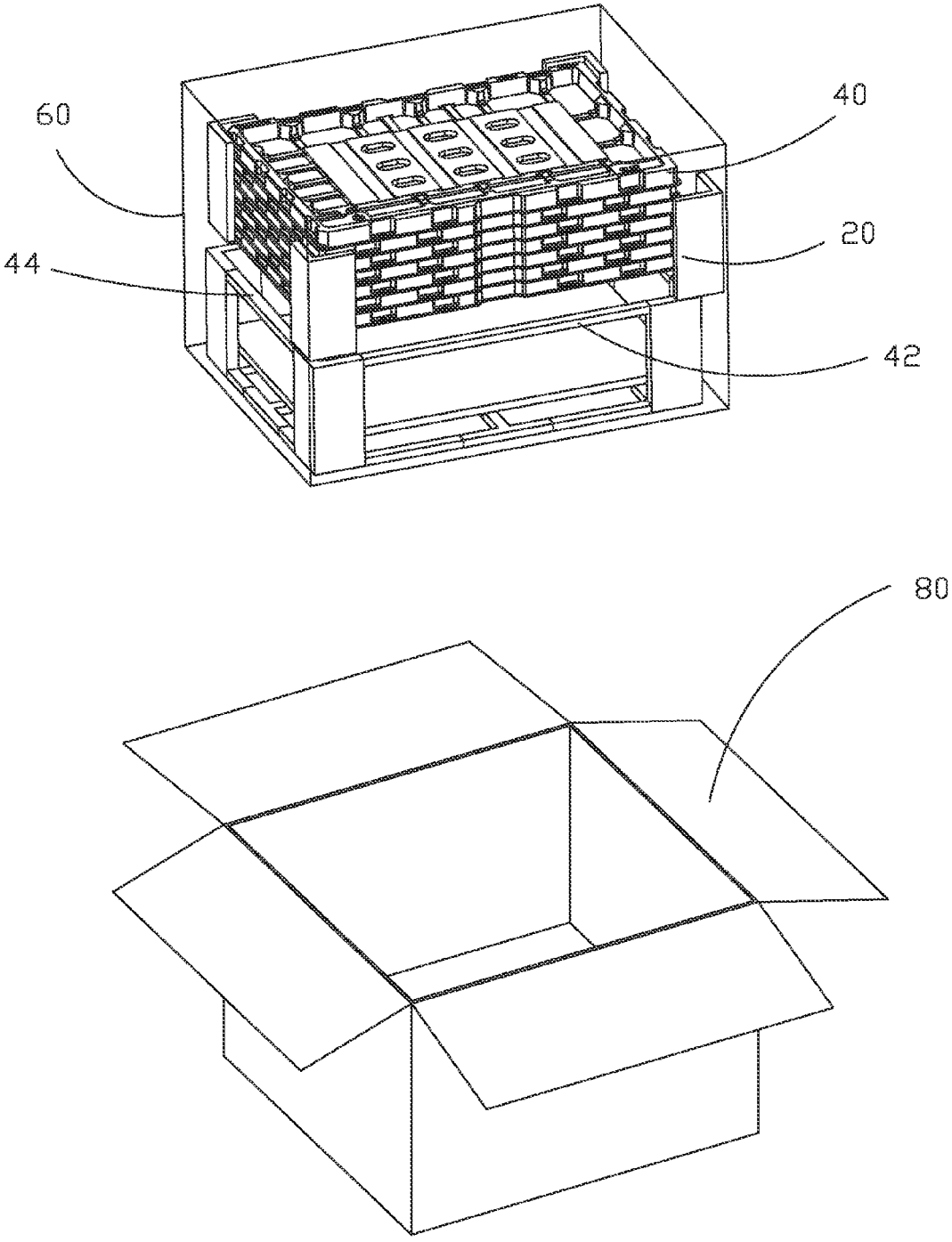
FIG. 6 is a schematic view illustrating placing liquid crystal glass panels into the support frame for packaging a liquid crystal glass panel according to the present invention.

Referring to FIG. 6, which is a schematic view illustrating placing liquid crystal glass panels into the support frame for packaging a liquid crystal glass panel according to the present invention, the packaging process is as follows. Firstly, liquid crystal glass panels and vacuum suction molded trays 40 are placed, in an alternate manner, into a support frame 20. The support frame 20 in which the liquid crystal glass panels and the vacuum suction molded trays 40 are placed is then placed into a packaging bag 60. The packaging bag 60 which is completed filled with support frames 20 is then deposited in a packaging box 80. During the process, handling can be done with the first or second upper-side bars 42, 44 of the support frame 20 without direct application of force to the vacuum suction molded tray 40 or the liquid crystal glass panel, while supporting is effected by the cruciform carriage rack 264 of the bottom bracket 260, whereby it can be ensured that the liquid crystal glass panel is protected against deformation and breaking caused by external forces during the process of handling.

Figure 7:
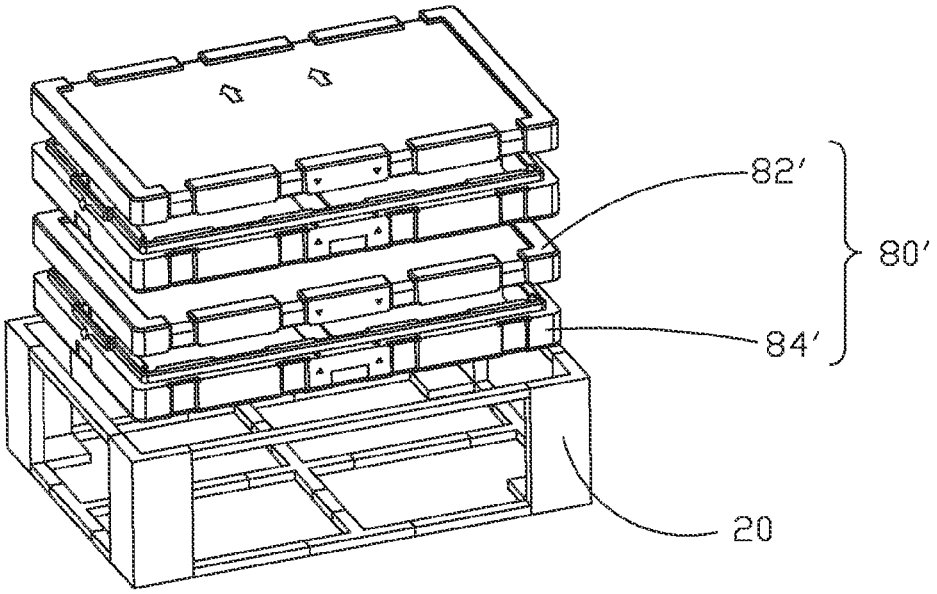
FIG. 7 is a schematic view illustrating another embodiment of placing liquid crystal glass panels into the support frame for packaging liquid crystal glass panels according to the present invention.

Referring to FIG. 7, which is a schematic view illustrating another embodiment of placing liquid crystal glass panels into the support frame for packaging liquid crystal glass panel according to the present invention, in the instant embodiment, the support frame 20 is applied to move liquid crystal glass panels for shipping or storage. The liquid crystal glass panels are received and held in packaging boxes 80' made of foamed materials. Each of the packaging boxes 80' comprises an upper cover 82' and a lower cover 84' and the liquid crystal glass panel is held between the upper cover 82' and the lower cover 84'. The packaging boxes 80' are stacked inside the support frame 20 to support the liquid crystal glass panels, so that the wall thickness of the packaging box 80' can be greatly reduced to save the material used in manufacture thereof and thus reduce the manufacturing cost.

Figure 8:
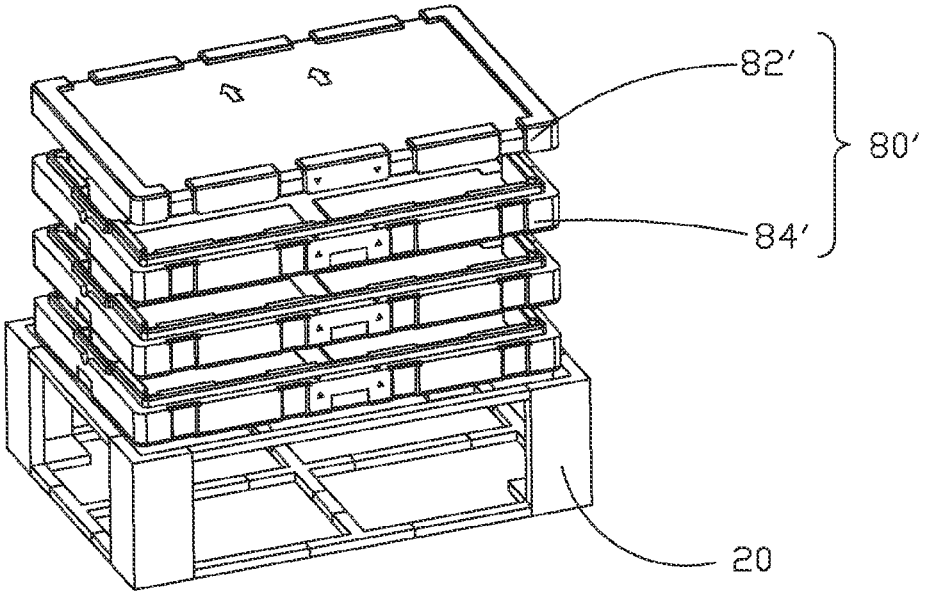
FIG. 8 is a schematic view illustrating a further embodiment of placing liquid crystal glass panels into the support frame for packaging liquid crystal glass panels according to the present invention.

Referring to FIG. 8, which is a schematic view illustrating a further embodiment of placing liquid crystal glass panels into the support frame for packaging liquid crystal glass panel according to the present invention, in the instant embodiment, the support frame 20 is applied to move liquid crystal glass panels for assembling, the lower covers 84' of the packaging boxes 80' are stacked inside the support frame 20 with only one the upper cover 82' set on the topmost stage in order to facilitate removal of the liquid crystal glass panels.

In summary, the present invention provides a support frame for packaging liquid crystal glass panel, wherein the support frame that is rigid may reinforce the tray in order to eliminate the problem of deformation of vacuum suction molded trays occurring in the known art when the trays are stacked or being handled. Further, the support frame is of a knockdown arrangement composed of multiple components in such a way that a portion of the components may be shared for contained products of different sizes so as to reduce the manufacturing cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A support frame adapted to receive and package a pile of liquid crystal glass panels that are stacked in a vertical direction, the pile of liquid crystal glass panels having a top surface, a bottom surface opposite to the top surface, and four side surfaces extending in the vertical direction between the top surface and the bottom surface and defining a horizontal cross-section that is identical in the vertical direction from the bottom surface to the top surface, the support frame comprising: four separate corner pieces, a plurality of upper connection bars, and a plurality of lower connection bars, wherein the plurality of upper connection bars are connected to the four corner pieces to form an upper sub-frame that delimits and defines an upper hollow area corresponding in shape and size to the cross-section of the pile of liquid crystal glass panels to receive the pile of liquid crystal glass panels to move straight therethrough in the vertical direction;

wherein the plurality of lower connection bars are connected to the four corner pieces to form a bottom bracket, which comprises a lower sub-frame and a carriage rack, the lower sub-frame being arranged to correspond to the upper sub-frame and delimiting and defining a lower hollow area corresponding, in the vertical direction, to the upper hollow area and corresponding in shape and size to the cross-section of the pile of liquid crystal glass panels, the carriage rack being connected to the lower sub-frame and located in the lower hollow area delimited by the lower sub-frame;

wherein each of the corner pieces comprises two side plates connected to each other and each extending between and connected to the upper sub-frame and the lower sub-frame, the side plates of the corner pieces and the upper and lower sub-frames collectively defining a hollow volume having an upper opening formed by the upper hollow area delimited by the upper sub-frame, the hollow volume having a horizontal cross-sectional area corresponding to the horizontal cross-section of the pile of the liquid crystal glass panels in order to receive the pile of the liquid crystal glass panels into the hollow volume in such a way that the side surfaces of the pile of the liquid crystal glass panels are in engagement with the side plates of the corner pieces to guide the movement of the pile of liquid crystal glass panels through the upper hollow area into the hollow volume to reach a predetermined location inside the hollow volume, each of the corner pieces further comprising a bottom plate extending from the side plates into the lower hollow area delimited by the lower sub-frame and partly covering a lower opening of the hollow volume such that at the predetermined location, the bottom surface of the pile of liquid crystal glass panels are positioned on and supported by the bottom plate and the side surfaces of the pile of liquid crystal glass panels maintain in engagement with the side plates of the corner pieces to retain the pile of liquid crystal glass panels in position; and wherein the bottom plates of the corner pieces and the carriage rack collectively define a plane adapted to support the bottom surface of the pile of liquid crystal glass panels thereon and retain the liquid crystal glass panels in the hollow volume.

2. The support frame as claimed in claim 1, wherein the corner pieces, the upper connection bars, and the lower connection bars are all rigid.

3. The support frame as claimed in claim 1, wherein the upper connection bars comprise two opposite first upper-side bars and two opposite second upper-side bars, the first and second upper-side bars being respectively connected to the four corner pieces to form the upper sub-frame that is rectangular.

4. The support frame as claimed in claim 3, wherein the corner pieces have top ends forming first and second upper coupling slots corresponding to the first and second upper-side bars, the first and second upper-side bars each having two ends forming first and second upper jointing sections respectively corresponding to the first and second upper coupling slots, the first and second upper jointing sections being respectively received and removably retained in the first and second upper coupling slots to connect the first and second upper-side bars and the corner pieces together to form the upper sub-frame.

5. The support frame as claimed in claim 3, wherein the first upper-side bars, the second upper-side bars, and the corner pieces are made of injection moldings of plastics.

6. The support frame as claimed in claim 3, wherein the first upper-side bars, the second upper-side bars, and the corner pieces are made of aluminum alloy.

7. The support frame as claimed in claim 1, wherein the lower connection bars comprise four T-shaped pieces, a cruciform piece, six first lower-side bars, and six second lower-side bars, the T-shaped pieces, the cruciform piece, the first lower-side bars, the second lower-side bars, and the corner pieces collectively forming the lower sub-frame that is of a rectangular configuration and the carriage rack that is of a cruciform configuration.

8. The support frame as claimed in claim 7, wherein two T-shaped pieces of the four T-shaped pieces have two opposite ends that are located on a straight line and are respectively connected to ends of two first lower-side bars and an additional end that is set perpendicular to said two ends and is connected to an end of one second lower-side bar, the other ends of the two first lower-side bars being respectively connected to the corner pieces; the other two T-shaped pieces of the four T-shaped pieces have two opposite ends that are located on a straight line and are respectively connected to ends of second lower-side bars and an additional end that is set perpendicular to said two ends and is connected to an end of one first lower-side bar, the other ends of the two second lower-side bars being respectively connected to the corner pieces; and the other ends of the first and second lower-side bars that are connected to said additional ends of the T-shaped pieces that are set perpendicular to the opposite ends are respectively connected to ends of the cruciform piece.

9. The support frame as claimed in claim 8, wherein the corner pieces comprise first and second lower coupling slots formed in bottom ends thereof and respectively corresponding to the first and second lower-side bars, the first and second lower-side bars each having two ends forming the first and second lower jointing sections, three ends of each of the T-shaped pieces forming third lower coupling slots, four ends of the cruciform piece forming fourth lower coupling slots, the first lower jointing sections being engageable with the first lower coupling slots, the third lower coupling slots, or the fourth lower coupling slots, the second lower jointing sections being engageable with the second lower coupling slots, the third lower coupling slots, or the fourth lower coupling slots.

10. The support frame as claimed in claim 7, wherein the T-shaped pieces, the cruciform piece, the first lower-side bars, and the second lower-side bars are made of injection moldings of plastics.

11. The support frame as claimed in claim 7, wherein the T-shaped pieces, the cruciform piece, the first lower-side bars, and the second lower-side bars are made of aluminum alloy.

* * * * *